United States Patent [19]

Wataya

[11] Patent Number: 4,962,739

[45] Date of Patent: Oct. 16, 1990

[54] FUEL CONTROLLER FOR AN INTERNAL COMBUSTION ENGINE

[75] Inventor: Seiji Wataya, Himeji, Japan

[73] Assignee: Mitsubishi Denki Kabushiki Kaisha, Tokyo, Japan

[21] Appl. No.: 461,514

[22] Filed: Jan. 5, 1990

[30] Foreign Application Priority Data

Jan. 7, 1989 [JP] Japan ..... 1-1619
Mar. 14, 1989 [JP] Japan ..... 1-63077

[51] Int. Cl.[5] ..... F02D 41/04; F02D 41/30; F02M 51/00

[52] U.S. Cl. ..... 123/435; 123/478

[58] Field of Search ..... 123/435, 478, 480, 491

[56] References Cited

U.S. PATENT DOCUMENTS 4,760,825 8/1988 Morita ..... 123/435 X
4,841,935 6/1989 Yamada et al. ..... 123/435 X
4,866,620 9/1989 Abe et al. ..... 123/435 X
4,913,118 4/1990 Watanabe ..... 123/435

FOREIGN PATENT DOCUMENTS 21913 5/1981 Japan .
103965 6/1984 Japan .

*Primary Examiner*—Willis R. Wolfe
*Attorney, Agent, or Firm*—Sughrue, Mion, Zinn, Macpeak and Seas

[57] ABSTRACT

A fuel controller for an internal combustion engine has an air temperature sensor in an air intake pipe and a cylinder pressure sensor which measures the pressure within a cylinder of the engine during a compression stroke. A control unit calculates the air quantity in each cylinder based on the measured intake air pressure and cylinder pressure and controls the fuel injectors of the engine so as to obtain a desired air-fuel ratio.

6 Claims, 8 Drawing Sheets

FIG. 3
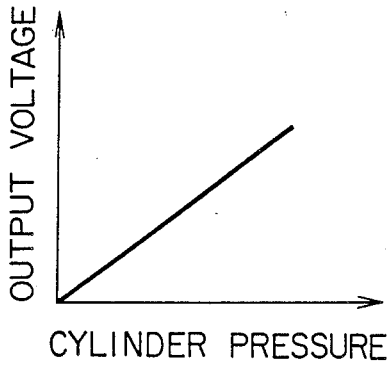
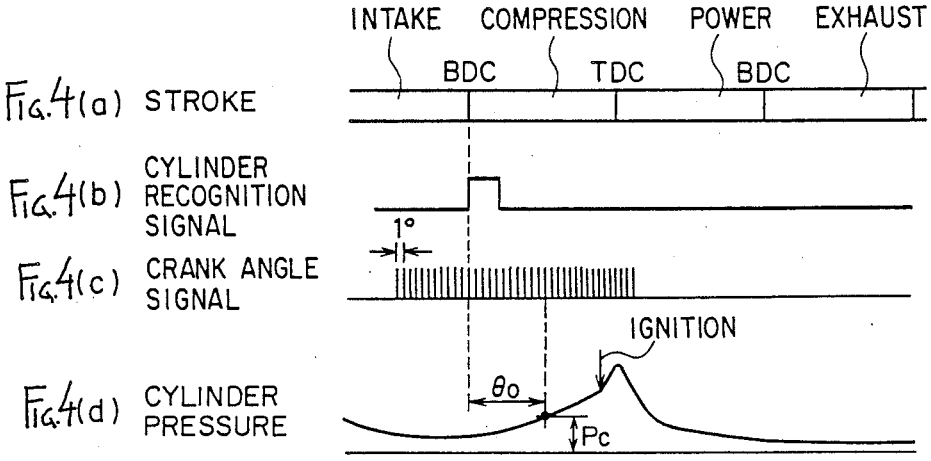

FIG. 8
(a)
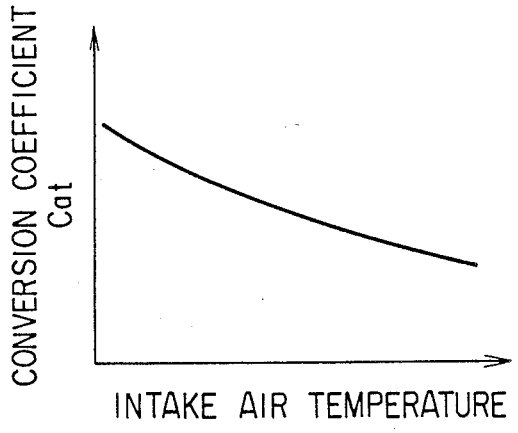
(b)
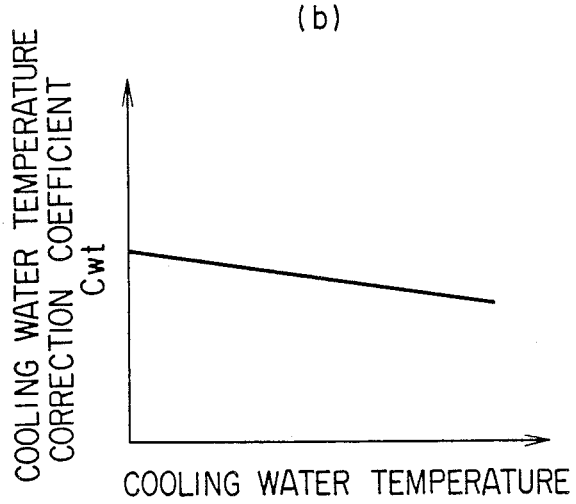

FUEL CONTROLLER FOR AN INTERNAL COMBUSTION ENGINE

BACKGROUND OF THE INVENTION

This invention relates to a fuel controller for an internal combustion engine. More particularly, it relates to a fuel controller which can accurately measure the mass air flow rate into an engine using inexpensive equipment and control the fuel supply to the engine according to the measured flow rate.

In modern automotive engines, the air flow rate into the engine is closely monitored as an indication of the engine load, and the amount of fuel which is supplied to the engine by fuel injectors is controlled in accordance with the measured air flow rate so as to obtain an optimal air-fuel ratio.

There are two types of devices for measuring the mass air flow rate into an engine which are commonly employed in fuel control systems. One type is a mass air flow sensor which directly measures the mass air flow rate. The other type, which is referred to as a speed-density air flow sensor, employs an air pressure sensor and a temperature sensor which are mounted in the intake pipe of an engine. Based on the measured pressure and temperature of the intake air, a control unit calculates the mass air flow rate. A mass air flow rate sensor has excellent sensing accuracy but it is expensive, so fuel control system for inexpensive vehicles often use the more economical speed-density air flow sensor.

In a speed-density air flow sensor, the air pressure sensor is normally disposed in the air intake pipe downstream of the throttle valve of the engine. When the throttle valve opens or closes, the pressure which is sensed by the air pressure sensor fluctuates, and it is therefore necessary to take the average of the measured pressure. However, the time required for averaging increases the signal processing time, so a fuel controller employing a speed-density air flow sensor has a poor response speed and can not quickly adjust the fuel supply in accordance with changing operating conditions of the engine.

SUMMARY OF THE INVENTION

It is an object of the present invention to provide a fuel controller for an internal combustion engine which can accurately and rapidly determine the mass air flow rate into the engine using inexpensive equipment.

It is another object of the present invention to provide a fuel controller which is highly responsive to changes in engine operating conditions.

A fuel controller according to the present invention determines the mass air flow rate of intake air into the cylinders of an engine based on the temperature of the intake air and the actual pressure within each cylinder at a prescribed point during its compression stroke. The pressure within the cylinders is directly measured by a pressure sensor, while the intake air temperature is measured by a temperature sensor disposed inside the air intake pipe of the engine. A control unit calculates the quantity of air in each cylinder based on the measured pressure and temperature. The control unit then controls the fuel injectors of the engine so as to attain a suitable air-fuel ratio based on the calculated quantity of air.

As the pressure within the cylinders is measured directly, there are no fluctuations in pressure due to the opening and closing of the throttle valve. Therefore, it is not necessary to average the pressure measurements to compensate for fluctuations, so the signal processing time can be reduced by the amount normally required for averaging, and the quantity of intake air can be accurately and quickly determined.

A fuel controller according to the present invention comprises an air temperature sensor which measure the temperature of intake air, a cylinder pressure sensor for measuring the pressure within a cylinder of the engine, a rotation sensor for sensing the rotation of the engine, and a control unit. The control unit includes means for determining when the piston of a cylinder reaches a prescribed position in its compression stroke, means for calculating the quantity of air in the cylinder at the prescribed piston position, means for calculating the amount of fuel to be supplied to the engine based on the calculated quantity of air, and means for controlling a fuel injector of the engine to supply the calculated amount of fuel to the engine. In a preferred embodiment, the control unit is constituted by a microprocessor.

In preferred embodiments, the present invention is applied to an automotive engine, but it is applicable to any type of internal combustion engine.

BRIEF DESCRIPTION OF THE DRAWINGS

FIG. 3 is a graph of the output characteristics of the cylinder pressure .sensor of FIG. 1.

FIGS. 4(*a*)–(*d*) are timing diagrams showing the levels of various output signals during the operation of the embodiment of FIG. 1.

FIGS. 8*a* and 8*b* are graphs of the coefficients $C_{at}$ and $C_{wt}$ as a function of the intake air temperature and the cooling water temperature, respectively.

DESCRIPTION OF THE PREFERRED EMBODIMENTS

Figure 1:
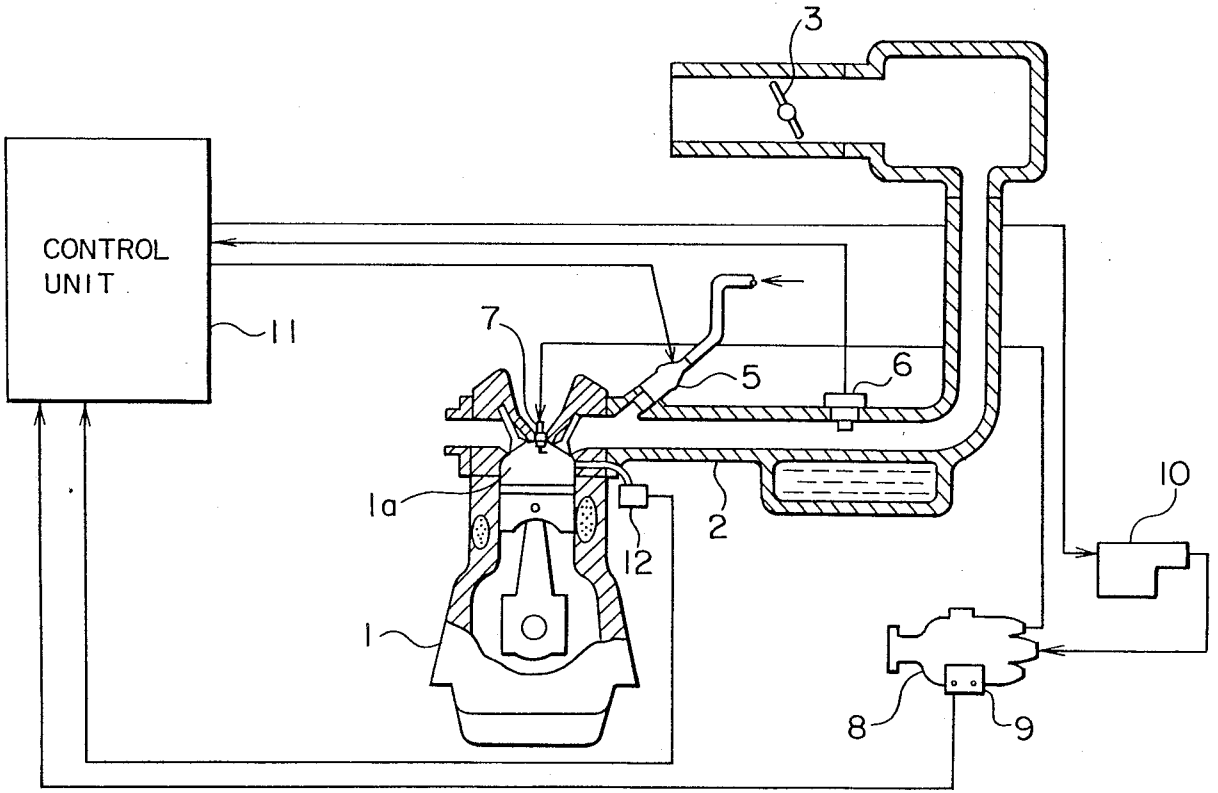
FIG. 1 is a schematic illustration of a first embodiment of a fuel controller according to the present invention.

A number of preferred embodiments of a fuel controller for an internal combustion engine according to the present invention will now be described while referring to the accompanying drawings. FIG. 1 schematically illustrates a first embodiment of the present invention as applied to a multi-cylinder automotive engine. As shown in this figure, an engine 1 having a plurality of cylinders 1*a*, only one of which is shown, is equipped with an air intake pipe 2, at the upstream end of which a throttle valve 3 is pivotally mounted. Fuel injectors 5 are mounted in the intake pipe 2 in the vicinity of the intake valves of the cylinders 1*a*. The illustrated engine employs multi-point fuel injection, but throttle body fuel injection can instead by employed. The fuel injectors 5 are electrically controlled by a control unit 11. An air temperature sensor 6 is mounted in the air intake pipe 2 downstream of the throttle valve 3. It senses the air temperature within the air intake pipe 2 and provides the control unit 11 with a corresponding electrical signal. Each of the cylinders la is equipped with a spark plug 7 which receives an ignition voltage from an ignition coil 10 via a distributor 8. The ignition coil 10 is controlled by the control unit 11. The distributor 8 has an unillustrated distributor shaft which is connected to and rotated by a suitable portion of the engine 1, such as the camshaft. The distributor 8 also houses a rotation sensor 9 which senses the rotation of the distributor shaft and provides corresponding electrical signals to the control unit 11. The rotation sensor 9 generates two types of signals. One is a crank angle signal (shown in FIG. 4*c*) which is generated at prescribed intervals of crankshaft rotation, such as one pulse for every degree of crankshaft rotation. The other signal is a cylinder recognition signal, shown in FIG. 4*b*. This signal is generated each time one of the pistons of the engine 1 is at a prescribed angular position. For example, in the present embodiment, the cylinder recognition signal is generated each time one of the pistons is at bottom dead center at the start of its compression stroke. Many different types of rotation sensors are commonly available, and any type which can generate the desired signals can be employed. One common type of rotation sensor which can be used includes a disc which is mounted on the distributor shaft and which has a large number of slits formed in its periphery. A light-emitting element, such as an LED, and a light-sensitive element, such as a phototransistor, are mounted on opposite sides of the disc in alignment with one another. As the distributor shaft rotates, the disc also rotates and interrupts the passage of light from the light-emitting element to the light-sensitive element. The light-sensitive element generates an output signal in the form of electrical pulses having a frequency corresponding to the rotational speed of the disc.

Each cylinder 1*a* is equipped with a cylinder pressure sensor 12 which measures the pressure within one of the cylinders 1*a* and generates a corresponding electrical signal which is provided to the control unit 11. The pressure sensors 12 need not be of any particular type. For example, they can be semiconductor piezoelectric pressure sensors which generate a voltage corresponding to the sensed cylinder pressure. FIG. 3 shows the output voltage of a pressure sensor 12 as a function of the measured cylinder pressure. In this example, the output voltage is linearly proportional to the cylinder pressure, but linear proportionality is not a requirement.

Figure 2:
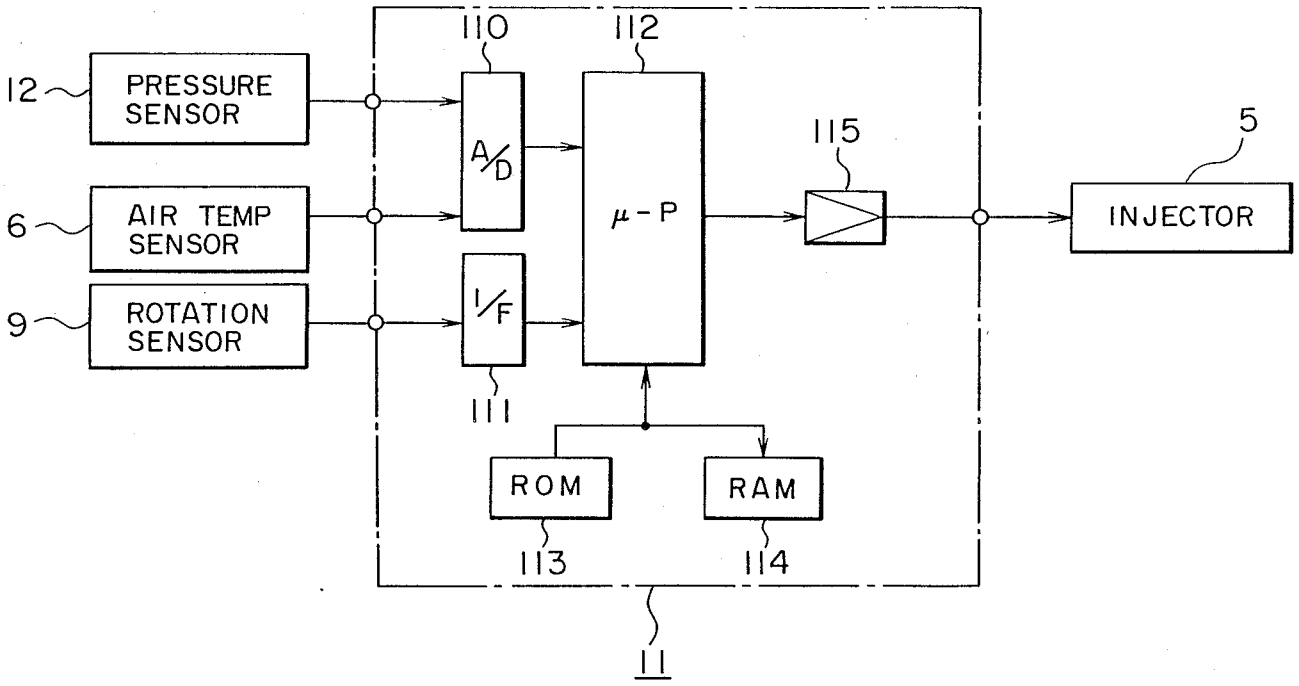
FIG. 2 is a block diagram of the control unit of the embodiment of FIG. 1.

FIG. 2 is a block diagram of an example of the control unit 11. It includes an A/D converter 110 which receives analog input signals from the air temperature sensor 6 and the cylinder pressure sensor 12 and converts the analog signals into digital signals, which are provided to a microprocessor 112. The signals from the rotation sensor 9 are also input to the microprocessor 112 via an interface 111. A ROM 113 stores data and programs which are executed by the microprocessor 112, while a RAM 114 performs temporary data storage. Based on the input signals from the sensors, the microprocessor 112 calculates the pulse width of drive pulses for the fuel injectors 5 and drives the injectors 5 through a drive circuit 115.

The operation of the embodiment of FIG. 1 will now be described while referring to FIG. 5, which is a flow chart of a program performed by the microprocessor 112. The control unit 11 continually receives the cylinder recognition signal and the crank angle signal from the rotation sensor 9. In Step 100, the control unit 11 determines whether the piston of the cylinder which is now performing compression has reached a prescribed angular position. Namely, the control unit 11 determines whether the crankshaft has rotated by a predetermined angle $\Theta_0$ since the bottom dead center position of the piston which is now performing compression. The piston position is determined by counting the number of pulses of the crank angle signal since the most recent occurrence of the cylinder recognition signal. The prescribed piston position $\Theta_0$ can be any position between the piston position at which the intake valve of the cylinder 1*a* closes and top dead center. When the piston position equals the predetermined position $\Theta_0$, the program proceeds to Step 101, in which the cylinder pressure Pc in the cylinder 1*a* which is now performing compression is read in from the corresponding cylinder pressure sensor 12 and stored in the RAM 114 or in a register of the microprocessor 112.

Next, in Step 102, the microprocessor 112 reads in and stores the intake air temperature which was measured by the air temperature sensor 6. In Step 103, the nominal quantity (i.e., mass) of air Q*a* in the cylinder 1*a* now in its compression stroke is calculated by the formula $V_{\Theta 0} \times Pc \times C_{at}$, wherein $V_{\Theta 0}$ is the volume of the cylinder 1*a* at piston position $\Theta_0$, Pc is the cylinder pressure, and $C_{at}$ is a conversion coefficient, which when multiplied by the pressure Pc gives the density of the air within the cylinder 1*a*. $C_{at}$ is a predetermined function of the intake air temperature measured by the air temperature sensor 6. The value of the conversion coefficient $C_{at}$ is illustrated in FIG. 8*a* as a function of the intake air temperature. This relationship can be stored in the ROM 113 as a look-up table, and the microprocessor 112 can determine the conversion coefficient $C_{at}$ from the look-up table based on the measured intake air temperature. The cylinder volume $V_{\Theta 0}$ at piston position $\Theta_0$ is computed in advance and stored in the ROM 113.

The nominal quantity of air Qa calculated in Step 103 is larger than the actual quantity of combustible air in the cylinder 1*a*, since it includes some exhaust gas which remains in the cylinder la after the previous exhaust stroke. It is therefore necessary to correct the nominal air quantity Qa for the exhaust gas remaining in the cylinder 1*a*. In Step 104, the engine rotational speed Ne is calculated using the output of the rotation sensor 9, and in Step 105, the actual air quantity Qa' (nominal air quantity - remaining exhaust gas) is calculated using the formula $Qa' = Ko(Ne, Qa) \times Qa$, wherein Ko is a charging correction coefficient, which is a predetermined function of the rotational speed Ne and the nominal air quantity Qa. This function can be stored in the ROM 113 in the form of a look-up table.

In Step 106, the drive pulse width $\tau$ for the fuel injectors 5 is calculated by the formula $\pi = K1 \times 1/K(A/F) \times Qa'$, wherein K1 is the flow rate gain of the fuel injectors 5 and K(A/F) is a function of the desired air-fuel ratio A/F. The desired air-fuel ratio for the engine 1 is calculated by the control unit 11 on the basis of input signals from the various sensors. Algorithms for calculating the air-fuel ratio of an engine are well known to those skilled in the art, and any suitable algorithm can be employed. The resulting pulse width $\tau$ is then stored in the RAM 114. At the appropriate time, the microprocessor 112 provides the drive circuit 115 with a drive pulse having the pulse width $\tau$, and the appropriate fuel injector 5 is driven to supply fuel to one of the cylinders 1*a*. The calculated pulse width $\tau$ can be used to control the fuel injector 5 for the next cylinder 1*a* to be supplied fuel, or it can be used to control the fuel injector 5 for the cylinder 1*a* which is now in its compression stroke the next time it is supplied fuel.

The program then recycles to Step 100 and the same series of calculations is successively carried out for each cylinder of the engine.

It can be seen that an engine fuel controller according to the present invention can accurately determine the mass flow rate of intake air into an engine employing inexpensive equipment. Furthermore, since it is not necessary to average the output signal of the pressure sensor 6 to compensate for fluctuations in the intake air pressure due to opening and closing of the throttle valve 3, the mass flow rate can be quickly determined, so the fuel supply can be rapidly adjusted in accordance with changes in the engine operating conditions.

Figure 6:
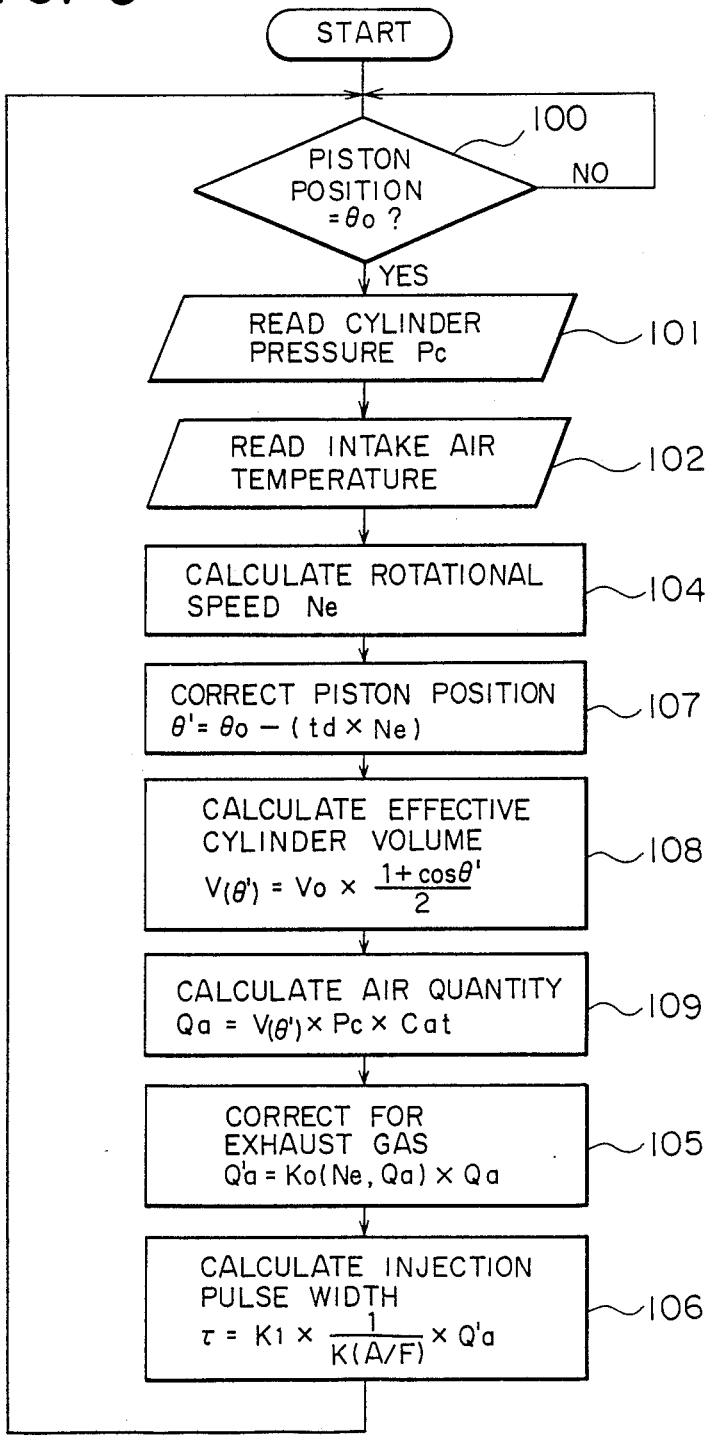
FIG. 6 is a flow chart of the operation of a second embodiment of the present invention.

FIG. 6 illustrates a flow chart of a program performed by the control unit of a second embodiment of a fuel controller according to the present invention. This embodiment has the same structure as the embodiment of FIG. 1 and differs only with respect to the program executed by the control unit 11. As shown in FIG. 6, the control unit 11 reads in the cylinder pressure Pc when the piston of a cylinder 1*a* which is performing compression reaches a prescribed angle $\Theta_0$ after bottom dead center (Steps 100 and 101). In Step 102, the intake air temperature is read from the air temperature sensor 6 and stored in the RAM 114. Next, in Step 104, the engine rotational speed Ne is calculated based on the output of the rotation sensor 9.

The pressure sensor 12 has a prescribed response time, and it also takes a prescribed length of time for the signal which is output by the pressure sensor 6 to be stored in the RAM 114. Therefore, at crank angle $\Theta_0$, the pressure value Pc which is read in from the pressure sensor 12 is not the pressure at piston position $\Theta_0$ but is the pressure at a different piston position $\Theta'$ ($\Theta' < \Theta_0$). In Step 107, the value of this piston position $\Theta'$ is calculated by the formula $\Theta' = \Theta_0 - (td \times Ne)$, wherein td is the total of the response time of the pressure sensor 12 and the storage delay time of the control unit 11, and Ne is the rotational speed of the crankshaft of the engine 1 in degrees/second. The total delay time td is a known characteristic of the pressure sensor 12 and the control unit 11 and is previously stored in the ROM 113.

Next, in Step 108, the cylinder volume $V_{\Theta'}$, at piston position $\Theta'$ is calculated by the formula $V_{\Theta'} = V_0 \times (1 + \cos\Theta')/2$, wherein $V_0$ is the cylinder displacement. In Step 109, the nominal air quantity Qa in the cylinder 1*a* is calculated by the formula $Qa = V\Theta' \times Pc \times C_{at}$, wherein Pc is the pressure measured by the pressure sensor 12 and $C_{at}$ is the above-mentioned conversion coefficient. In Step 105, the actual air quantity Qa' is calculated, and in Step 106, the pulse width $\tau$ of a drive pulse for one of the fuel injectors 5 is calculated in the same manner as in the program of FIG. 5. The program then recycles to Step 100.

Figure 5:
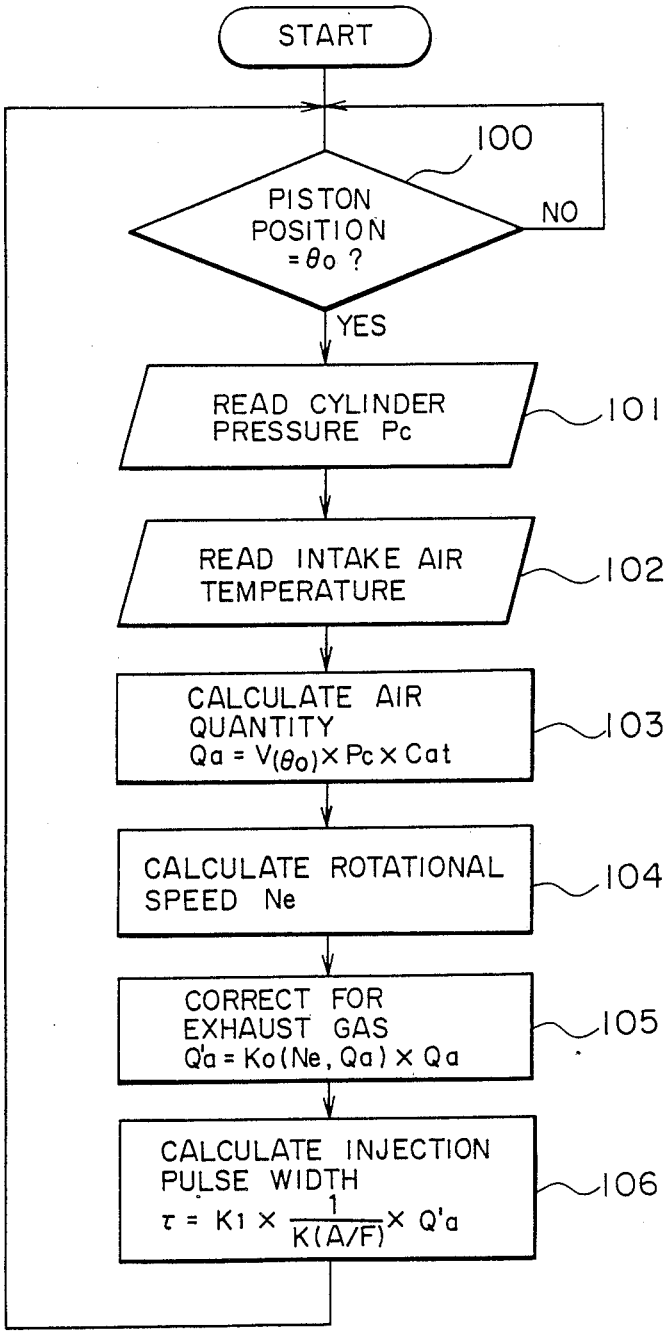
FIG. 5 is a flow chart of the operation of the embodiment of FIG. 1.

The operation of this embodiment is thus basically similar to that of the embodiment of FIG. 5, but since time delays due to the response time of the pressure sensor 12 and storage delays of the control unit 11 are compensated for, the fuel supply can be more accurately controlled.

In the illustrated embodiments, the air temperature sensor 6 is mounted in the air intake pipe 2 and measures the temperature of intake air before it has entered a cylinder 1*a*. It is theoretically possible to install a temperature sensor inside a cylinder 1*a* and to measure the average temperature of the air-fuel mixture within the cylinder 1*a*. However, it is difficult to manufacture a temperature sensor which can withstand the intense heat within a cylinder during combustion, so from the standpoint of durability, it is preferable for the temperature sensor 6 to be located outside of the cylinders 1*a*.

On the other hand, since the temperature sensor 6 is located in the air intake pipe 2, the temperature which is measured by the temperature sensor 6 may differ from the temperature of the intake air in the cylinders 1*a*. This is because the heat of the engine 1 may increase the temperature of the intake air between the time that it flows past the air temperature sensor 6 and the time that it actually enters the cylinders 1*a*. As the intake air is heated, it expands and decreases in density. Therefore, if the density of the intake air is calculated using only the conversion coefficient $C_{at}$, which is a function of the air temperature sensed by the temperature sensor 6, the calculated density will be higher than the actual density of the intake air in the cylinders 1*a*.

Figure 7:
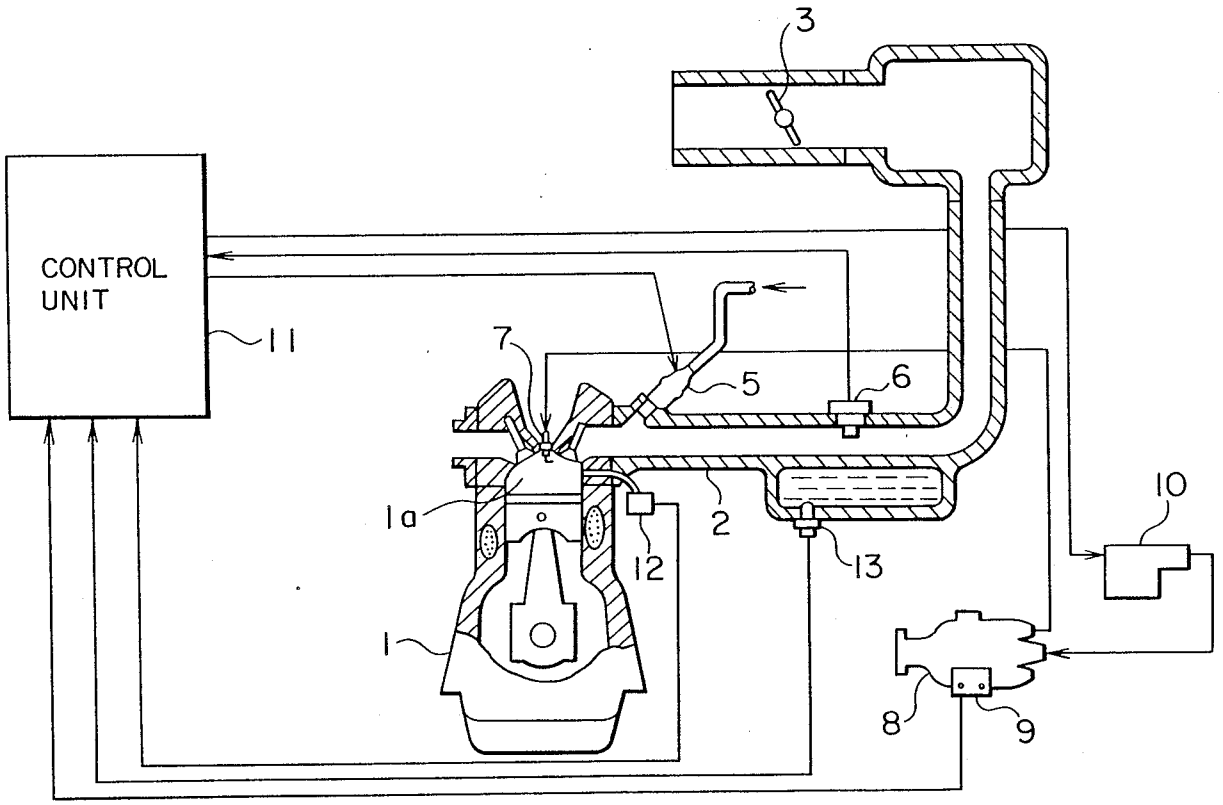
FIG. 7 is a schematic diagram of a third embodiment of the present invention.

This problem is solved in a third embodiment of the present invention, which is illustrated in FIG. 7. This embodiment is similar in structure to the embodiment of FIG. 1 but is further equipped with an engine temperature sensor in the form of a water temperature sensor 13 which senses the temperature of the cooling water for the engine 1. The water temperature sensor 13 generates an electrical output signal corresponding to the cooling water temperature and provides the signal to the microprocessor 112 of the control unit 11 via the A/D converter 110. Based on the cooling water temperature, the control unit 11 determines a cooling water temperature correction coefficient $C_{wt}$. As shown in FIG. 8*b*, this coefficient $C_{wt}$ decreases in value as the cooling water temperature increases. The relationship between the cooling water temperature correction coefficient $C_{wt}$ and the cooling water temperature can be previously stored in a look-up table in the ROM 113. The cooling water temperature correction coefficient $C_{wt}$ is chosen so that the product $C_{at} \times C_{wt}$ will accurately reflect the density of intake air when it enters the cylinders 1*a*.

Figure 9:
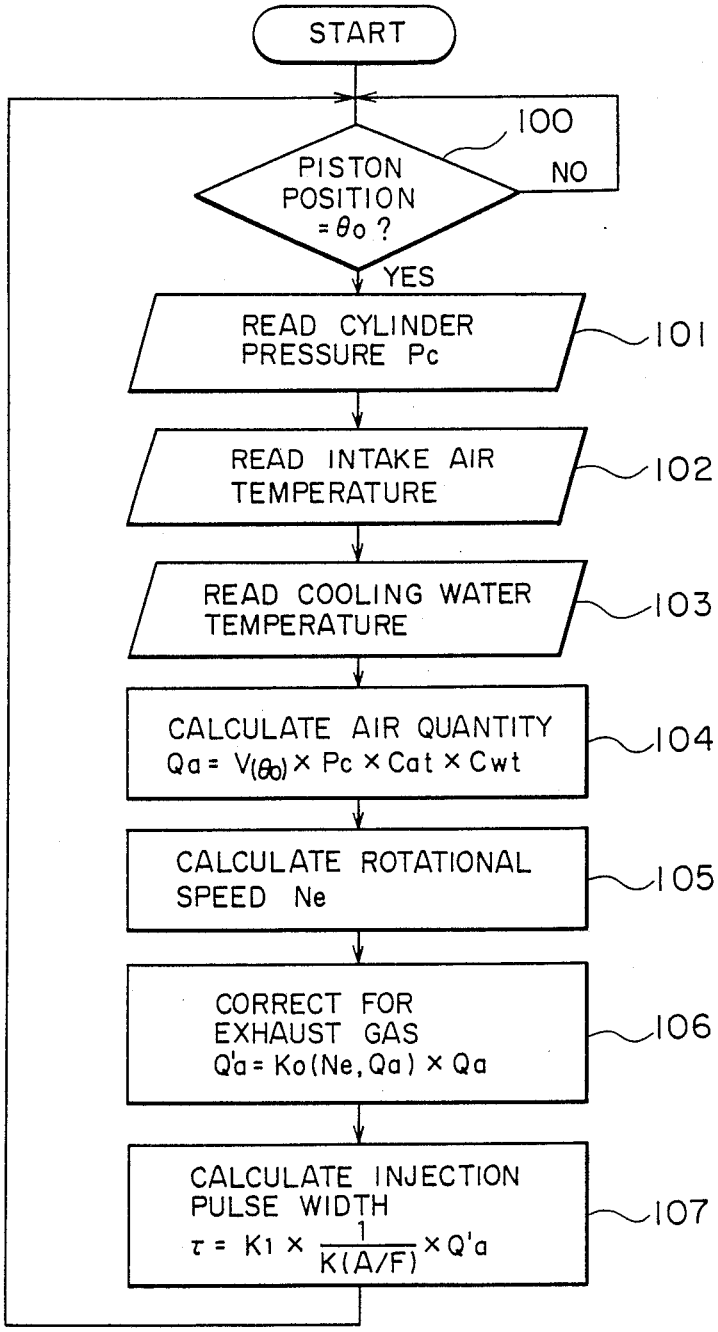
FIG. 9 is a flow chart of the operation of the embodiment of FIG. 7.

FIG. 9 is a flow chart of a program performed by the control unit 11 of this embodiment. Steps 100–102 are identical to the corresponding steps in the program of FIG. 5. In Step 103, a signal indicating the cooling water temperature is read from the water temperature sensor 12, and in Step 104, the nominal air quantity Qa in the cylinder 1*a* is calculated by the formula $Qa = V_{\Theta 0} \times Pc \times C_{at} \times C_{wt}$, wherein $Pc \times C_{at} \times C_{wt}$ is the density of the air in the cylinder 1*a* when the cylinder volume is $V_{\Theta 0}$. The subsequent steps correspond to Steps 104–106 of FIG. 5, and the overall operation of this embodiment is similar to that of the embodiment of FIG. 1. However, since the air density of the intake air is corrected for a rise in its temperature as it flows between the air temperature sensor 6 and the cylinders 1*a*, the air quantity Qa' can be more accurately calculated, and accordingly, the fuel supply can be more accurately controlled.

In the above-described embodiments, each cylinder 1*a* of the engine 1 is equipped with an individual pressure sensor 12. However, it is possible to employ fewer pressure sensors 12 than there are cylinders 1*a*. For example, a single pressure sensor 12 can be employed for all the cylinders 1*a*, or one pressure sensor 12 can be provided for one half of the cylinders and another pressure sensor 12 for the other half of the cylinders. Decreasing the number of pressure sensors 12 results in somewhat of a decrease in the control accuracy, but the cost of the apparatus can be significantly decreased.

In the illustrated embodiments, the present invention is applied to a liquid-cooled engine, but it can also be applied to an air-cooled engine.

What is claimed is:

1. A fuel controller for an internal combustion engine comprising:

an air temperature sensor for measuring the temperature of intake air into the engine;

a cylinder pressure sensor for measuring the pressure within a cylinder of the engine;

a rotation sensor for sensing the rotation of a portion of the engine;

position sensing means responsive to the rotation sensor for determining when a piston in a cylinder of the engine reaches a prescribed position while performing compression;

air quantity calculating means responsive to the air temperature sensor and the cylinder pressure sensor for calculating the quantity of air in a cylinder of the engine at the prescribed piston position;

fuel supply calculating means responsive to the air quantity calculating means for calculating the amount of fuel to be supplied to the engine to obtain a prescribed air-fuel ratio; and drive means for driving a fuel injector of the engine so as to supply the calculated amount of fuel to the engine.

2. A fuel controller as claimed in claim 1 wherein the air temperature sensor is mounted in an air intake pipe of the engine.

3. A fuel controller as claimed in claim 1 further comprising an engine temperature sensor for sensing the temperature of the engine, wherein the air quantity calculating means comprises means for calculating the quantity of air in a cylinder at the prescribed piston position based on the intake air temperature, the cylinder pressure, and the engine temperature.

4. A fuel controller as claimed in claim 3, wherein the engine temperature sensor comprises a coolant temperature sensor for sensing the temperature of a coolant for the engine.

5. A fuel controller for a multi-cylinder internal combustion engine comprising:

an air temperature sensor which is mounted in an intake pipe of the engine and generates an electric signal corresponding to the air temperature in the intake pipe;

a plurality of cylinder pressure sensors, each of which measures the pressure in one of the cylinders of the engine and generates a corresponding electric signal;

a rotation sensor for sensing the rotation of the crankshaft of the engine; and a control unit comprising:

position determining means responsive to the rotation sensor for determining when the piston of a cylinder of the engine is at a prescribed piston position in its compression stroke;

air quantity calculating means responsive to the signals from the temperature sensor and the cylinder pressure sensor for calculating the quantity of air in the cylinder performing compression at the prescribed piston position;

means for calculating a drive pulse width for a fuel injector of the engine based on the calculated air quantity; and injector drive means for driving a fuel injector of the engine with a drive pulse having the calculated pulse width.

6. A fuel controller for a multi-cylinder, liquid-cooled internal combustion engine comprising:

an air temperature sensor which is mounted in an intake pipe of the engine and generates an electric signal corresponding to the air temperature in the intake pipe;

a pressure sensor which measures the pressure in one of the cylinders of the engine and generates a corresponding electric signal;

a coolant temperature sensor for sensing the temperature of liquid coolant of the engine and generating a corresponding electric signal;

a rotation sensor for sensing the rotation of the engine; and a control unit comprising:

position determining means responsive to the rotation sensor for determining when a piston of the engine is at a prescribed piston position while performing compression;

first calculating means responsive to the signals from the air temperature sensor, the coolant temperature sensor, and the pressure sensor for calculating the quantity of air in a cylinder at the prescribed piston position;

pulse width calculating means for calculating a drive pulse width for a fuel injector of the engine so as to obtain a prescribed air-fuel ratio; and injector drive means for driving a fuel injector of the engine with a drive pulse having the calculated pulse width.

* * * * *